US005669486A

United States Patent [19]

Shima

[11] Patent Number: 5,669,486

[45] Date of Patent: Sep. 23, 1997

[54] ILLUMINATED SWITCH

[75] Inventor: Mitsunori Shima, Tokyo, Japan

[73] Assignee: Fuji Polymeritech Co., Ltd., Tokyo, Japan

[21] Appl. No.: 648,564

[22] Filed: May 16, 1996

[30] Foreign Application Priority Data

Aug. 7, 1995 [JP] Japan ..... 7-219450

[51] Int. Cl.[6] ..... H01H 9/00

[52] U.S. Cl. ..... 200/314; 200/512; 200/313

[58] Field of Search ..... 200/314, 313, 200/512, 311, 310, 317

[56] References Cited

U.S. PATENT DOCUMENTS

| | | | |
|---|---|---|---|
| 4,811,175 | 3/1989 | DeSmet | 200/314 |
| 4,916,262 | 4/1990 | Jungels-Butler et al. | 200/5 A |
| 5,149,923 | 9/1992 | Demeo | 200/314 |

*Primary Examiner*—David J. Walczak

*Attorney, Agent, or Firm*—McGlew and Tuttle

[57] ABSTRACT

A illuminated switch where a coned disc spring embossed into a dome shape with transparent thermoplastic resin is used on the top surface of a surface illuminant layer such as an EL element and where a feeling of click and better illumination are obtained.

18 Claims, 2 Drawing Sheets

ILLUMINATED SWITCH

BACKGROUND OF THE INVENTION

1. Field of the Invention

The present invention relates to an illuminated switch where the display used in the console panel of a mobile communication equipment such as a portable telephone, or measuring instruments, or vehicle-mounted electronic instruments, or the like, can be visually recognized even in dark places.

2. Description of the Prior Art

A conventional illuminated switch, provided with a metallic coned disc spring 11, uses a light emitting diode (LED) or an electro-luminescent (EL) element as an illuminating means 13, as shown in FIG. 3. In a case where the light emitting diode 13 is used as the illuminating means, it demands much electricity and there is a limitation on the number of LEDs to be used in a single product, so each LED is disposed between keys 17 to reduce the number of LEDs. However, in this case the luminance brightness is not uniform depending upon such keys. Disposing the LED just under the key is disadvantageous in that demand becomes problematic, structure becomes complicated, and furthermore, cost is increased.

On the other hand, in a switch where a surface illuminant such as an EL element is used as an illuminating means 23, as is shown in FIG. 4, an opaque member 21 such as a metallic coned disc spring is interposed in order to make sure the on-off feel of the switch at the time of operation. For this reason, a portion just under the key 27 is not illuminated but illumination is performed from the circumferential edge of the metallic spring, so sufficient illumination is not provided.

BRIEF SUMMARY OF THE INVENTION

In accordance with the present invention, a spring portion having a click type resin dome (hemisphere) embossed with a transparent thermoplastic resin is disposed on the top surface of an elastic surface illuminant layer such as an EL element where a conductive portion is provided on the back surface spaced by an insulating layer infigure of frame. Furthermore, on the top surface of the spring a display key is disposed.

With this structure, a spring comprising a resin dome formed with a transparent thermoplastic resin is used in the intermediate portion of the switch instead of an opaque metallic coned disc spring, whereby the high luminance illumination from the surface illuminant layer underlying just under the display key can be provided with respect to the display. In addition, a better feeling of input operation can be given to users by the resin dome, so no mistaken operation will occur. Furthermore, the labor for assembling the metallic coned disc spring needed in the conventional method can be omitted and a assembley working process can be shortened.

Moreover, a multilayer surface illuminant, comprising a phosphor layer and a dielectric layer, is disposed only on a portion positioned just under the display, whereby an expensive phosphor layer material can be saved and also cost can be reduced.

Further objects and advantages of the present invention will become apparent from the following description of the preferred embodiments of the invention as illustrated in the accompanying drawings.

BRIEF DESCRIPTION OF THE DRAWINGS

FIG. 2 is a structural diagram of the present invention, showing the switch being turned on;

DETAILED DESCRIPTION OF THE PREFERRED EMBODIMENT

Figure 1:
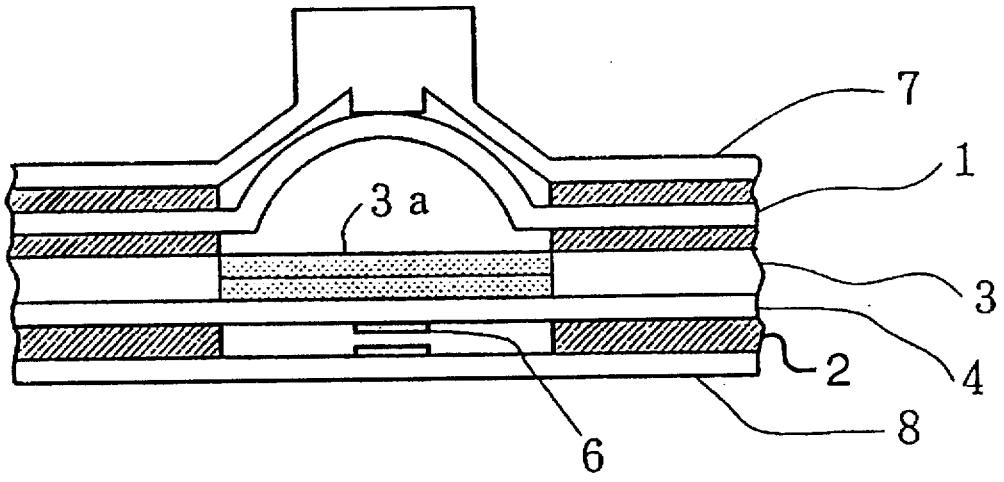
FIG. 1 is a structural diagram of a switch according to the present invention.

A preferred embodiment of the present invention will hereinafter be described with reference to the accompanying drawings.

On the back surface of an elastic surface illuminant layer 3 comprising either an EL element or a surface LED, a conducting portion 6 and a printed board 8 are disposed through an insulating frame layer 4. On the top surface of the surface illuminant layer 3, a spring 1, comprising a resin dome embossed into a hemispherical shape with a transparent thermoplastic resin such as polyester resin, is disposed so as to be positioned Just above the lower conducting portion 6 through a spacer 2 which serves for leaving a space between them.

Furthermore, on the top surface of the spring 1, a display key 7 is disposed.

The surface illuminant layer 3 is layer-formed so that a phosphor layer performing an illuminating operation and a dielectric layer are positioned only on a portion 3*a* disposed just under the display key 7 and the dome-shaped spring 1. With this structure, only the display key 7, which is a necessary but minimum portion, can be illuminated, so demand of much electricity can be considerably reduced and an expensive phosphor layer material can be reduced.

Figure 2:
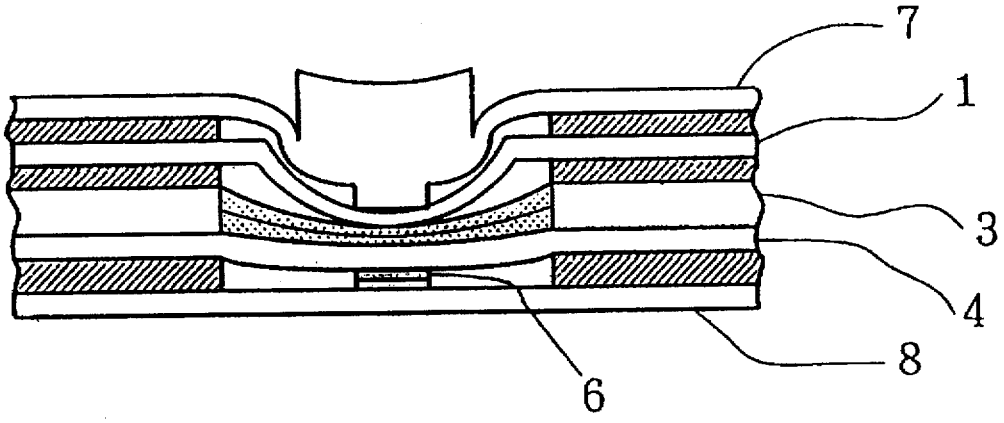
Figure 3:
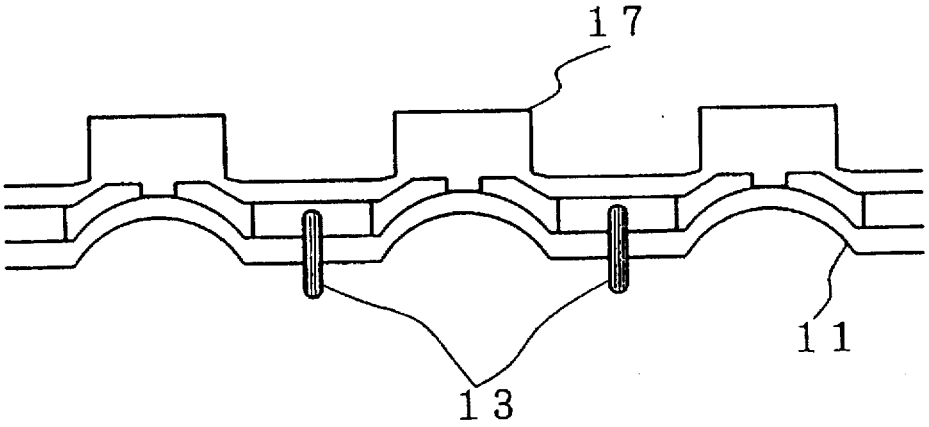
Fig. 3 (PRIOR ART)
FIG. 3 is a diagram showing a conventional switch using a light emitting diode.
Figure 4:
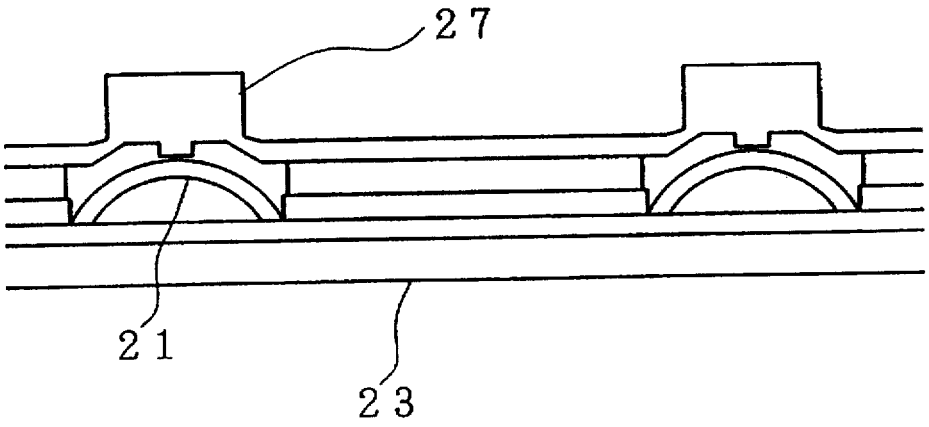
Fig. 4 (PRIOR ART)
FIG. 4 is a diagram showing a conventional switch using an EL element.

FIG. 2 shows the operation of the switch when the display key 7 is pressed. At the same time the display key 7 presses the spring portion 1 to obtain a feeling of click, that is, buckling, the underlying surface illuminant layer 3 and conductive portion 6 are pushed down and connected to lower electrodes.

I claim:

1. An illuminated switch comprising:

an elastic surface illuminant layer;

a conductive portion provided on a back surface of said elastic surface illuminant layer through an insulating layer; and a spring provided on a top surface of said elastic surface illuminant layer and having a click type transparent resin dome embossed into a dome shape with a transparent thermoplastic resin, the dome shaped portion of the spring being disposed so as to be positioned just above said conductive portion.

2. The illuminated switch according to claim 1, wherein said spring has a display portion comprising thermoplastic resin which is partially transparent to the top surface of said elastic surface illuminant layer.

3. The illuminated switch according to claim 2, wherein said spring has a display portion and said surface illuminant layer and a rear electrode layer underlying the surface illuminant layer are disposed on a portion positioned only just under said display portion.

4. The illuminated switch as set forth in claim 2, wherein said surface illuminant layer consists of an electro-luminescent element.

5. The illuminated switch as set forth in claim 2, wherein said surface illuminant layer consists of a surface light emitting diode.

6. The illuminated switch according to claim 1, wherein said spring has a display portion and said surface illuminant layer and a rear electrode layer underlying the surface illuminant layer are disposed on a portion positioned only just under said display portion.

7. The illuminated switch as set forth in claim 6, wherein said surface illuminant layer consists of an electroluminescent element.

8. The illuminated switch as set forth in claim 6, wherein said surface illuminant layer consists of a surface light emitting diode.

9. The illuminated switch as set forth in claim 1, wherein said surface illuminant layer consists of an electroluminescent element.

10. The illuminated switch as set forth in claim 1, wherein said surface illuminant layer consists of a surface light emitting diode.

11. An illuminated switch comprising:

a display key;

an illumination source comprised of an elastic surface illuminant layer;

an insulating frame layer disposed adjacent to said illuminant layer;

a conductive portion provided on said insulating layer on a back side of said elastic surface illuminant layer; and spring means including a click type transparent resin dome embossed into a dome shape spring portion with a transparent thermoplastic resin, said dome shaped spring portion being disposed so as to be positioned just above said conductive portion, wherein only said spring portion is disposed between said display key and said illuminant layer.

12. The illuminated switch according to claim 11, wherein said spring has a display portion comprising thermoplastic resin which is partially transparent to the top surface of said elastic surface illuminant layer.

13. The illuminated switch according to claim 11, wherein said spring has a display portion and said surface illuminant layer and a rear electrode layer underlying the surface illuminant layer are disposed on a portion positioned only just under said display portion.

14. The illuminated switch as set forth in claim 1, wherein said surface illuminant layer consists of an electroluminescent element.

15. An illuminated switch comprising:

a display layer;

spring means including a click type transparent resin dome embossed into a dome shaped spring portion with a transparent thermoplastic resin, said dome shaped spring portion being part of a spring layer and being disposed adjacent to said display layer with no structural element disposed between said display key layer and said transparent resin dome;

an illumination source consisting of an elastic surface illuminant layer providing substantially uniformly distributed illumination over a surface area, said illuminant layer being disposed adjacent to said dome shape spring portion with no structural element disposed between said spring layer and said illuminant layer;

an insulating frame layer in contact with said illuminant layer; and a conductive portion layer provided on said insulating layer on a side of said insulating layer which is opposite said elastic surface illuminant layer, said dome shaped spring portion being disposed just above said conductive portion.

16. The illuminated switch according to claim 15, wherein said display layer has a display portion comprising thermoplastic resin which is partially transparent to the top surface of said elastic surface illuminant layer.

17. The illuminated switch according to claim 15, wherein said illuminant layer and conductive portion layer underlying the surface illuminant layer are disposed on a portion positioned under and aligned with said display portion.

18. The illuminated switch as set forth in claim 15, wherein said surface illuminant layer consists of an electroluminescent element.

* * * * *